US006062991A

United States Patent [19]

Moriarty et al.

[11] Patent Number: 6,062,991

[45] **Date of Patent: *May 16, 2000**

[54] COMMUNICATION, CALCULATION, AND RECORD KEEPING METHOD AND APPARATUS FOR GOLF COURSE

[76] Inventors: Stephen A. Moriarty, 319 Meadowood La., St. Paul, Minn. 55127; James C. Rathmanner, 4340 Reiland La., St. Paul, Minn. 55126; Nicholas P. Van Brunt, 1 Bald Eagle Island, White Bear Lake, Minn. 55110

[ * ] Notice: This patent issued on a continued prosecution application filed under 37 CFR 1.53(d), and is subject to the twenty year patent term provisions of 35 U.S.C. 154(a)(2).

[21] Appl. No.: 08/628,599

[22] Filed: Apr. 5, 1996

[51] Int. Cl.[7] ..... A63F 9/22; G06F 15/44

[52] U.S. Cl. ..... 473/407; 473/409; 463/42

[58] Field of Search ..... 463/1, 30, 31, 463/40–42, 29; 364/410, 411; 340/323 R; 473/130, 407, 409; 235/380, 375; 700/91, 92

[56] References Cited

U.S. PATENT DOCUMENTS

| | | | |
|---|---|---|---|
| 3,921,049 | 11/1975 | Mellors et al. . | |
| 4,521,014 | 6/1985 | Sitrick | 463/40 |
| 4,744,430 | 5/1988 | McCoy . | |
| 4,764,666 | 8/1988 | Bergeron | 235/380 |
| 4,910,677 | 3/1990 | Remedio et al. | 364/410 |
| 4,958,835 | 9/1990 | Tashiro | 463/42 |
| 4,964,638 | 10/1990 | Ishida | 463/42 |
| 5,008,552 | 4/1991 | Kuramochi et al. | 235/483 |

(List continued on next page.)

OTHER PUBLICATIONS

Scoring by Unisys . . . With the USGA, "Building the First Internet Real–Time Golf Scoring System" (3 pages), "Hitting the Long Ball" (3 pages), "Real–Time Scoring" (2 pages) and "Unisys Computerized Golf Scoring and Information System" (1 page) each by Mike Heck, May–Jun. 1995.

News Release From Unisys Corporation, Release No. 0596/6020, May 1996.

Golfnet References: "Sumner Golfer Services" (2 pages) and "Golfnet Golfer Service Systems: 1000 Clubs—425,000 Golfers—11 Years of Success" (4 pages) by Sumner Inc, 1996.

*Primary Examiner*—Mark A. Sager
*Attorney, Agent, or Firm*—David B. Edgeworth

[57] ABSTRACT

An apparatus to provide golf players calculation, communication and record keeping of golf game scores. In addition communication of information pertaining to weather, flow of play, course topology and layout, advertising, service needs, emergency medical and security, rules of play and personal messages are provided to the players throughout the golf course by the apparatus. The apparatus includes a group of mechanisms distributed throughout the golf course area of play for the purpose of transferring this information between the players and the apparatus interactively and in real time. In the preferred embodiment the mechanisms distributed around the course are statically located, use photoelectric means for their electrical power needs and transfer data by radio communication means to and from a computing mechanism. The apparatus includes a computing mechanism that performs calculation steps needed to determine the golf game scores and also manages the transfer and storage of the various communications. In addition it extracts and saves information pertaining to the use of the course and its services for course management to use in accounting, planning and course improvement tasks. The computing mechanism can include programs to detect bottlenecks in the flow of play and alert course managers of the bottlenecks. In one embodiment, "timestamp" data which includes time, date, and/or location data is appended to at least some messages passed between the golfer interface and the manager interface. Additional programs that determine corrective modifications to the flow of play can be included in the computing mechanism.

17 Claims, 9 Drawing Sheets

U.S. PATENT DOCUMENTS

| | | | |
|---|---|---|---|
| 5,039,928 | 8/1991 | Nishi et al. . | |
| 5,043,889 | 8/1991 | Lucey | 364/412 |
| 5,044,634 | 9/1991 | Dudley | 273/32 R |
| 5,095,430 | 3/1992 | Bonito et al. | 364/410 |
| 5,101,354 | 3/1992 | Mowers et al. | 364/410 |
| 5,107,354 | 4/1992 | Yamazaki et al. . | |
| 5,118,105 | 6/1992 | Brim et al. | 273/54 |
| 5,127,044 | 6/1992 | Bonito et al. | 379/88 |
| 5,245,537 | 9/1993 | Barber | 364/410.1 |
| 5,255,185 | 10/1993 | Mowers et al. | 364/411 |
| 5,283,733 | 2/1994 | Colley | 364/411 |
| 5,319,548 | 6/1994 | Germain | 364/411.1 |
| 5,324,028 | 6/1994 | Luna | 273/32 R |
| 5,326,095 | 7/1994 | Dudley | 273/32 R |
| 5,332,218 | 7/1994 | Lucey | 273/138 A |
| 5,342,054 | 8/1994 | Chang et al. | 273/186 |
| 5,407,049 | 4/1995 | Jacobs . | |
| 5,446,894 | 8/1995 | DeMar et al. | 395/650 |
| 5,450,318 | 9/1995 | Mowers et al. | 364/410 |
| 5,469,175 | 11/1995 | Boman | 342/357 |
| 5,507,485 | 4/1996 | Fisher | 473/131 |
| 5,558,333 | 9/1996 | Kelson | 364/410.1 |
| 5,613,912 | 3/1997 | Slater | 463/29 |
| 5,779,566 | 7/1998 | Wilens | 473/131 |
| 5,797,809 | 9/1998 | Hyuga | 473/131 |

CENTRAL COMPUTER DATA BUFFER AND TRANSCEIVER CONTROL FLOW

COMMUNICATION, CALCULATION, AND RECORD KEEPING METHOD AND APPARATUS FOR GOLF COURSE

FIELD OF THE INVENTION

The invention relates generally to a geographically distributed computer system, and specifically to the scoring and record keeping of sporting activities and, more specifically to the scoring and record keeping of the game of golf.

BACKGROUND OF THE INVENTION

The game of golf is played by one or more players, hitting a small ball around a predetermined course. The course (also know as a golf course) consists of multiple shallow holes or cups in the ground and a specific starting position for each cup. A player hits the small ball using a club (also known as a golf club) from the starting position (an area known as a tee) toward the hole associated with the referenced tee. The objective of the game is to hit the small golf ball into a specified sequence of holes, with as few hits of the ball (known as strokes) as possible. In a group of players, the player who has taken the fewest number of strokes is the winner.

An important part of the game is the method of measuring relative performance of individuals or groups against each other or against the course. The performance of the players is currently measured manually through a method of counting, recording and calculating on paper. In most games of golf, after completion of each hole, the players verbally report the number of strokes each player required to complete the hole, and the number of strokes is recorded on paper. This is repeated through the play of multiple holes until all holes have been played. At this point the strokes of each player are manually totaled. Complex adjustments are now applied to the total number of stokes of each player to reflect the relative difficulty of the topology of the course and the measured skill level of the players under any chosen rules of competition. This pencil and paper method of scoring is tedious and error prone.

Other inventors that address some of these needs include Romedio (U.S. Pat. No. 4,910,677) and Bonito (U.S. Pat. Nos. 5,095,430 and 5,127,044). These all include mobile components that move about close to the human golfers as they play. These mobile components exchange data with one or more computing mechanisms operated by golf course management thus forming a distributed computing network. All three of these inventions transfer data between the players mobile components and the course management computers by way of physically transferred memory hardware at the beginning and end of games. This limits communication of data to and from the mobile components to that which is assumed to be static for the duration of the game. Current weather information and warnings, wind characteristics, service needs, emergency medical and security, personal messages and flow of play are not described by these inventors because all this data can change throughout the game.

Colly (U.S. Pat. No. 5,283,733) describes an invention that accumulates, calculates and communicates the scores of players throughout a given course. It does not describe a method to maintain handicaps or course-related correction factors or apply them to final game results. It also does not describe any other type of communication other than score related.

Luna (U.S. Pat. No. 5,324,028) describes a computer-based system for guiding golfers around a golf course in such a way as to minimize bottlenecks in the flow of play. The inventor does not describe the ability to automatically score the game or provide any other types of communication. Components of the system are installed at all tees and greens. Power supply wiring is required for each of these components making installation on an existing course a substantial task. The placement of components at the greens causes undesirable obstructions and appearance.

Dudley (U.S. Pat. No. 5,044,634) describes a golf information system distributed about the golf course area that provides golfers with distance information between numerous points on the course and tracks position, speed and timing of players throughout the course for monitoring flow of play and cart usage. The inventor does not describe the ability to automatically score the game or provide any other type of communication.

In addition, there are various conditions that can detract from the enjoyment of the game of golf. Some of these conditions are: 1) The game is played over a large geographic area and a long block of time, making communications with and between players throughout the course quite difficult. These communications may include weather information and warnings, course topology and layout, wind characteristics, advertising, service or medical or security needs, personal messages, or elaboration of rules of play; 2) Rates of play may vary between multiple groups of players on the course at any given time, causing delays, annoyances, and inefficient utilization of the golf course.

What is needed is a means to provide communications with players in a timely manner; a score calculations, tabulation, and memory system; a system to provide information to detect and improve the utilization of the golf course.

SUMMARY OF THE INVENTION

The invention is a communication, calculation, and record keeping apparatus for the game of golf. The invention comprises remote terminals (known as the golfer's interface) located throughout the golf course playing area, a central computing device located in a common area, such as the golf course club house, and the computer program to control the components and the functions. The components transfer information between the human golf players ("golfers") on the golf course and the central computing device. The information transfer is one in real time. The central manager accumulates stroke counts from the layers, calculates scores using and maintaining handicaps and course corrections and records scoring information. Other communication with and between players on the course include but are not limited to weather information and warnings, course topology and layout, wind characteristics, advertising, service needs, emergency medical and security, rules of play, personal messages, communications of tournament scores and control of the flow of play are passed between the apparatus and the players throughout the course. The apparatus is connected by a global network to similar apparatus at multiple other golf courses allowing any information thus dealt with to be available and used at any of these golf courses.

One embodiment of the present invention provides a method for communication, computing, and input of scores at a golf course, wherein the golf course has a plurality of golf holes, a plurality of remote terminals and a central computing device. The method includes the steps of:

a. receiving, at a first one of the plurality of remote terminals, a golfer identification, which represents one or more golfers;

b. receiving, at the first remote terminal, input representative of a golf score;

c. communicating, from the first remote terminal to the central computing device, data representative of the golfer's identification and the golf score; and d. recording to a storage medium, data representative of the golfer's identification, the golf score, and a value which identifies one of the plurality of golf holes.

In one such embodiment, the method according to the above description is used, wherein each one of the plurality of golf holes has a corresponding remote terminal.

In another such embodiment, the method further includes the step of:

e. communicating, from the central computing device to the one remote terminal, one or more of the following: a message comprising numerical, textual, sound, voice, or graphical information to be presented to the identified one or more golfers, data representative of a previous golf score, or data representative of a summed golf score.

In another such embodiment, the method further includes the step of communicating, from the central computing device at said golf course to another central computing device at another golf course, data representative of a summed golf score.

Another embodiment of the present invention includes a system for communication, computing, and input of scores at a golf course, the golf course having a plurality of golf holes. The system includes:

a central computing device having a storage medium and a data receiver; and a plurality of remote terminals, each remote terminal comprising one or more input device operable to receive a golfer identification which represents one or more golfers and to receive input representative of a golf score;

a data transmitter operable to communicate, from the remote terminal to the central computing device, data representative of the golfer identification and the golf score;

wherein the central computing device is configured to record to the storage medium upon receipt of data from one of the remote terminals, data representative of the golfer identification, the golf score, and a value which identifies one of the plurality of golf holes.

In one embodiment of this system, each of the plurality of golf holes has a corresponding remote terminal.

Another embodiment of this system further includes means for communicating, from the central computing device to the one remote terminal, one or more of the following: a message comprising numerical, sound, voice, textual, or graphical information to be presented to the identified one or more golfers, data representative of a previous golf score, or data representative of a summed golf score.

Yet another embodiment of this system further includes means for communicating, from the central computing device at said golf course to another central computing device at another or a plurality of golf courses, one or more of the following: a message comprising numerical, textual, or graphical information to be presented to the identified one or more golfers, data representative of a previous golf score, or data representative of a summed golf score.

In one embodiment, the components located in the playing area are statically mounted close to the tees. Negative effects of obstruction and appearance are minimized by this choice of location. These components require no physical connections for power or data transfer minimizing the installation task. Power is provided by a photoelectric array charging a battery and data is transferred by radio transmission.

DESCRIPTION OF PREFERRED EMBODIMENTS

In the following detailed description of the preferred embodiments, reference is made to the accompanying drawings that form a part hereof, and in which are shown by way of illustration specific embodiments in which the invention may be practiced. It is to be understood that other embodiments may be utilized and structural changes may be made without departing from the scope of the present invention.

Figure 1:
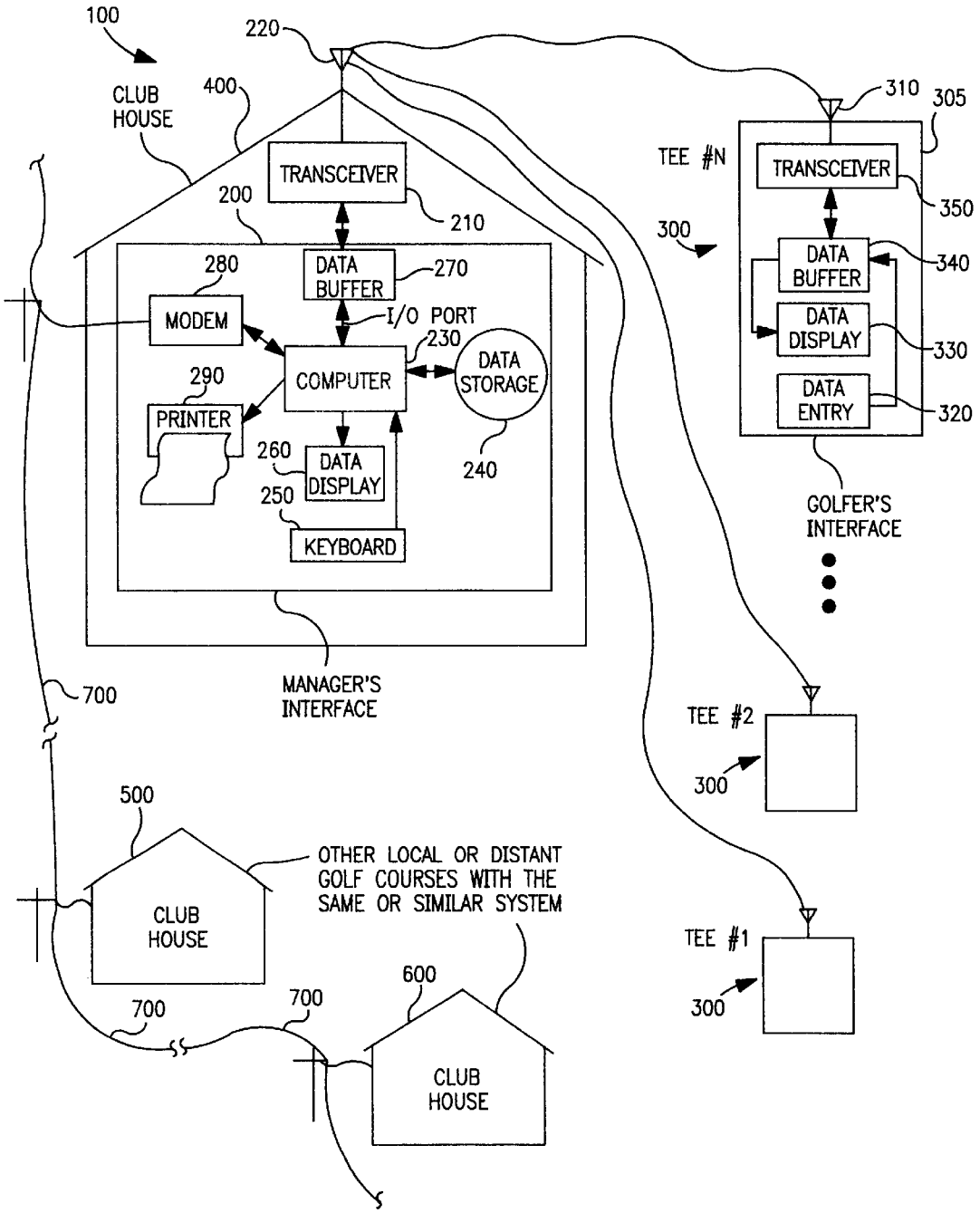
FIG. 1 is a diagram of an embodiment of the invention showing the golfer's interface 300 remote terminals located on the tees, the central computing device component located in the golf course club house, and the interconnections to other golf courses.

FIG. 1 is a representation of one embodiment of a golf network 100 including a Communication, Calculation, and Record Keeping Apparatus for Golf Course and showing the major functional electronic blocks and interconnections of one embodiment of the golf network 100 of the present invention. In this embodiment, golf network 100 comprises a manager's interface 200, a transceiver 210 for manager's interface 200, a club house 400 where manager's interface 200 is located, a radio antenna 220 for manager's interface 200, one or more golfer's interfaces 300, antenna 310 for one golfer's interface 300, telephone lines 700, and club houses 500 & 600 for other golf courses.

In this embodiment, the manager's interface 200 is a centrally located computing device having small general purpose computer 230 such as an IBM compatible personal computer, a data storage device 240 such as a large capacity hard disk drive, a data entry device 250 such as a computer keyboard or keypad, a data display device 260 such as a computer display monitor, a digital data modem 280, and a printing device 290, and a data buffer 270 which includes a DRAM memory for one embodiment. Another embodiment of the data buffer 270 includes SRAM memory; yet another embodiment of the data buffer 270 includes VRAM memory; and yet another embodiment of the data buffer 270 includes solid state memory. The manager's interface 200 can be located in the club house 400 or anywhere in the area of the golf course convenient for the operator's access. The manager's interface 200 is typically operated by the golf course management personnel. They control operation of golf network 100 through the keyboard 250 and data display 260. Data storage 240 is included to hold the software programs and information about the players' current and past golf scores including their game statistics. A printer 290 supplies hard copy records of game statistics and results of interest to players and other statistics of interest to managers. A digital data modem 280 provides access to other golf courses 500 & 600 with similar systems allowing global access of all stored data. In this embodiment, software programs written for this invention's application executing in the computer 230 control substantially all communication, computation and data storage and retrieval. The control software for golf network 100 is activated in the manager's interface 200. The golf network 100 system begins a continuing sequence that sends polling signals to each golfer's interface 300 in turn, rapidly sequencing from one golfer's interface 300 tee to the next.

In one embodiment, each golfer's interface 300 is a remote terminal having a data entry device 320, a data display device 330, a data buffer 340, and a transceiver 350. The golfer's interfaces 300 are located at separated locations throughout the golf course. They are shown in the preferred embodiment located in fixed positions at the golf tees. In other embodiments, each golfer's interface 300 could be located anywhere on the course or carried by the players, on the golf carts or in the golf bag. Data transfers between the manager's interface 200 and the golfer's interfaces 300 are through radio communication means in the preferred embodiment in order to ease setup and maintenance and to maintain aesthetic considerations. In other embodiments, these data transfers take place over wires, fiber optics, or various combinations of wire, fiber optic and/or radio communications links. Some of these conditions which are communicated in one embodiment are: 1). Weather information and warnings, course topology and layout, wind characteristics and wind in relation to the course, advertising, service or medical or security needs, personal messages, and elaboration of rules of play; 2) Rates of play may vary between multiple groups of players on the course at any given time, causing delays, annoyances, and inefficient utilization of the course.

Transceivers 210 & 350 are included in the communications paths that provide wireless digital data communication between the manager's interface 200 and the golfer's interfaces 300. Data is accumulated in transmit data buffers 270 & 340 for transmission by the transceiver 210 & 350 as a continuous data block thus minimizing transmission times. Data is also received as a continuous block and placed in the receive data buffers 270 & 340. Each golfer's interface 300 contains data entry 320 and display devices 330 used by the golf players. Data blocks are transferred between the manager's interface 200 and the golfer's interfaces 300 one at a time and one direction at a time in the preferred embodiment. The sequence and timing of the data transfers are controlled by the manager's interface computer 230. Data collisions between transfers from multiple tees are in this way avoided. In another embodiment, golf network 100 is implemented with fiber optic and/or hard wired connections to the tees if portability and ease of installation are not a requirement.

In one embodiment, there are two modes of communications between the manager's interface 200 and the golfer's interface 300. The transfer of alphanumeric characters would take the least time as the translation of the individual characters would be done through a character lookup table. The second mode of communications would be for such general information such as graphical information, such as a map of the golf course or a detailed map of the area from a specified tee to the associated hole showing the recommended route from the tee to the hole. The graphical data would need to be buffered up in the data buffer 300 & 270 to allow the electronics to assimilate the data in a manner the data display device 330 & 260 are capable of displaying. To differentiate between the two modes of communications, there would be a control code imbedded within the first part of the transmitted data block. One unique code would define the accompanying data block as containing character data, and another unique code defines the data as graphical, sound, voice, or other general types of data.

Figure 2:
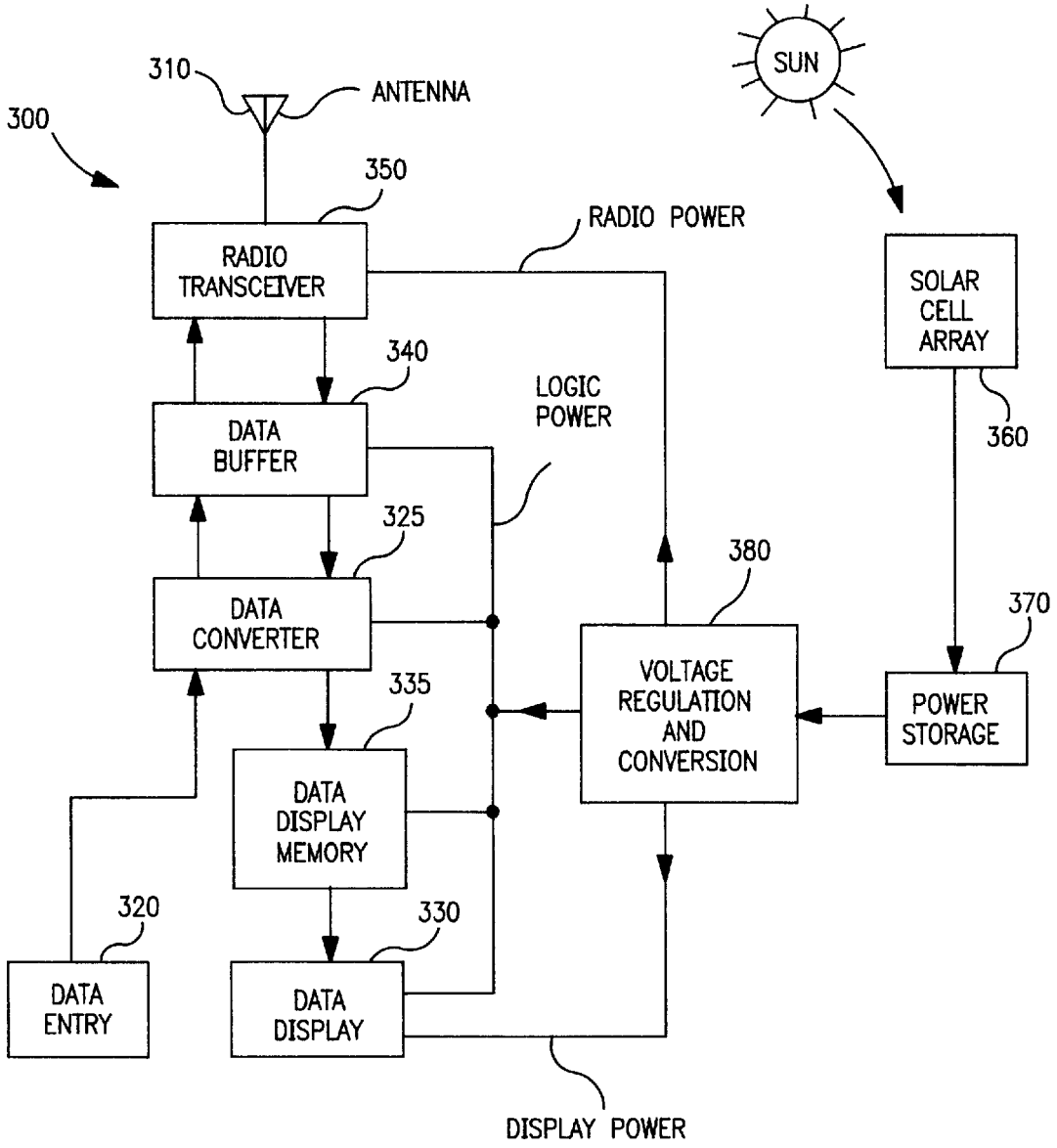
FIG. 2 Is a block diagram of the major electronic circuits and the interconnections of the electronic circuits contained in the golfer's interface 300.

A more detailed block diagram of the golfer's interface 300 is shown in FIG. 2. Golfers enter information through the data entry device 320 (in this embodiment, a keypad similar to that seen on a keypad of a telephone). The data entry device 320 is connected to the data converter 325 which converts key entries to digital codes. These digital codes are passed to the data buffer 340 where they are held until this golfer's interface 300 receives a signal from the manager's interface 200 indicating that it is time to transmit data. The digital codes are then passed one bit at a time to the transceiver 350 where they modulate a radio frequency carrier signal and are broadcast through the Antenna 310.

Radio signals modulated by digital codes are also received by the transceiver 350 where they are demodulated and converted to strings of digital codes. These codes pass to the data buffer 340 where they are held until they can be accepted by the data converter 325. The data converter 325 converts the data to a form that the data display device 330 can use. This display data is passed to the data display memory 335 where it is stored. The display data is read from the data display memory 335 in a continuous sequence and passed to the data display 330 according to the order and timing constraints of the data display's 330 detailed operation.

The golfer's interface 300 require electrical power that is provided by a solar cell 360 and stored in electrical storage device 370 in the preferred embodiment. Power is therefore quite limited. In one embodiment, power consumption is kept correspondingly low by keeping transmissions from the golfer's interfaces 300 brief and infrequent, the use of CMOS logic throughout and a liquid crystal type of display.

The solar cell array 360 connects to an electrical power storage device 370. The electrical power storage device 370 is charged by the solar cell array 360. The electrical power storage device 370 supplies power through connections to the voltage regulation and conversion circuit 380. The voltage regulation and conversion circuit 380 supplies power to the electronics contained in the golfer's interface 300 through connections according to the various voltage requirements of these circuits. These voltage levels are held nearly constant by the voltage regulation and conversion circuit 380. In other embodiments, the golfer's interfaces 300 could be powered by replaceable or rechargeable batteries if periodic maintenance is less a concern, or wired to an electrical power source if aesthetics, portability and ease of installation are not requirements or powered by the golf cart's battery if this was the preferred location for golfer's interface 300.

Figure 3A:
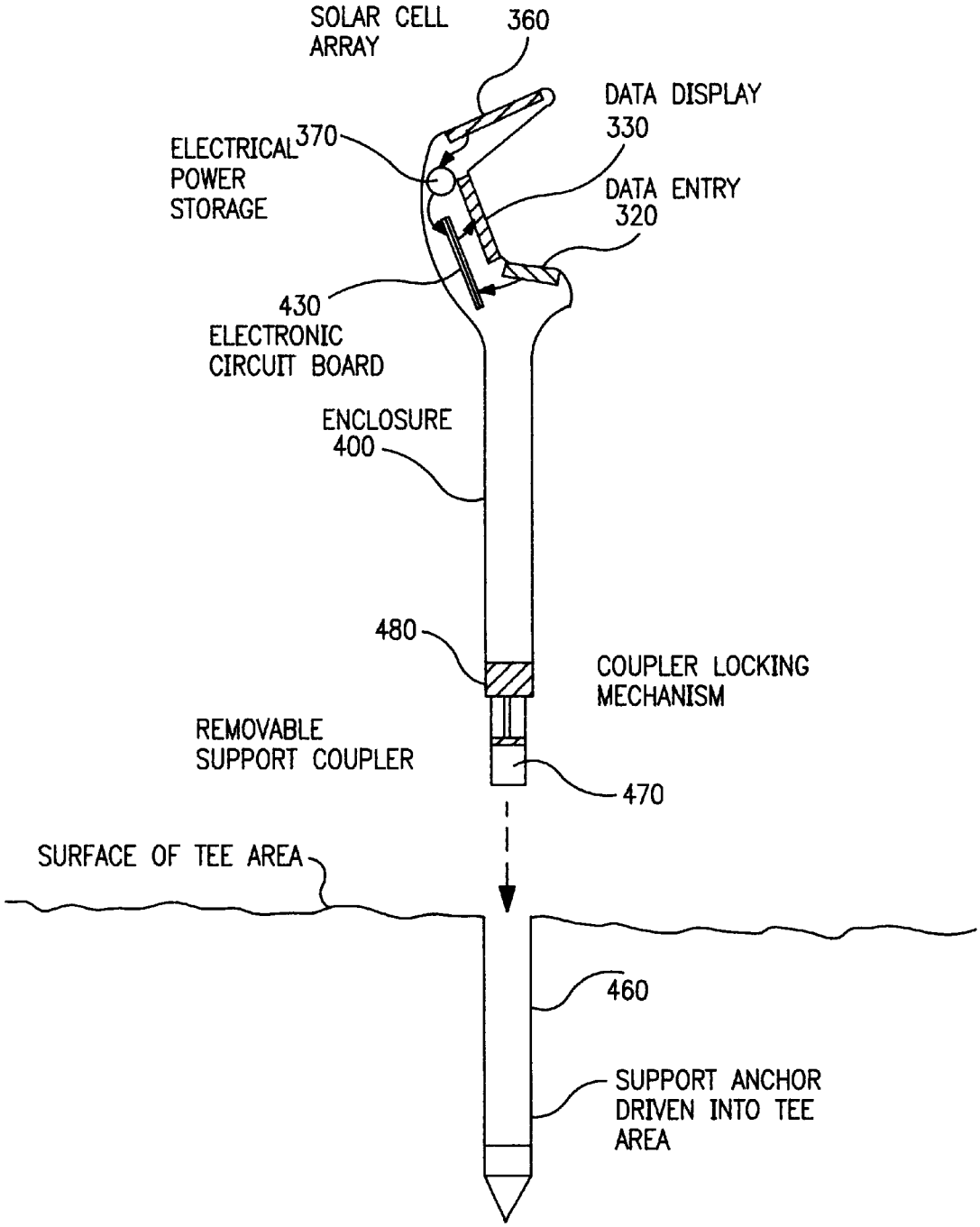
FIGS. 3A & 3B show one physical embodiment of the golfer's interface 300 and a mounting technique that is used in one embodiment.

In one embodiment, a physical representation of the golfer's interface 300 is shown in FIG. 3. A supporting enclosure 400 presents the data display 330 and data entry device 320 at a height and inclination comfortable for a standing adult. The electronics 430 are packaged on a typical printed circuit board. Power is supplied to the electronics through a solar cell 360 and an electrical power storage device 370. This eliminates maintenance associated with battery charging or the need for hard wires to supply power.

The enclosure 400 is weatherproof and impact-resistant allowing it to be left outdoors at the tees. It is connected at the base to a support anchor 460 embedded in the soil in the area of the tee. Connection to the support anchor 460 is through a removable coupler 470 that is released by a locking mechanism 480 operated by maintenance people. The golfer's interface 300 can therefore be easily removed and stored while the golf course is closed if security concerns require this or maintenance is required.

Figure 3B:
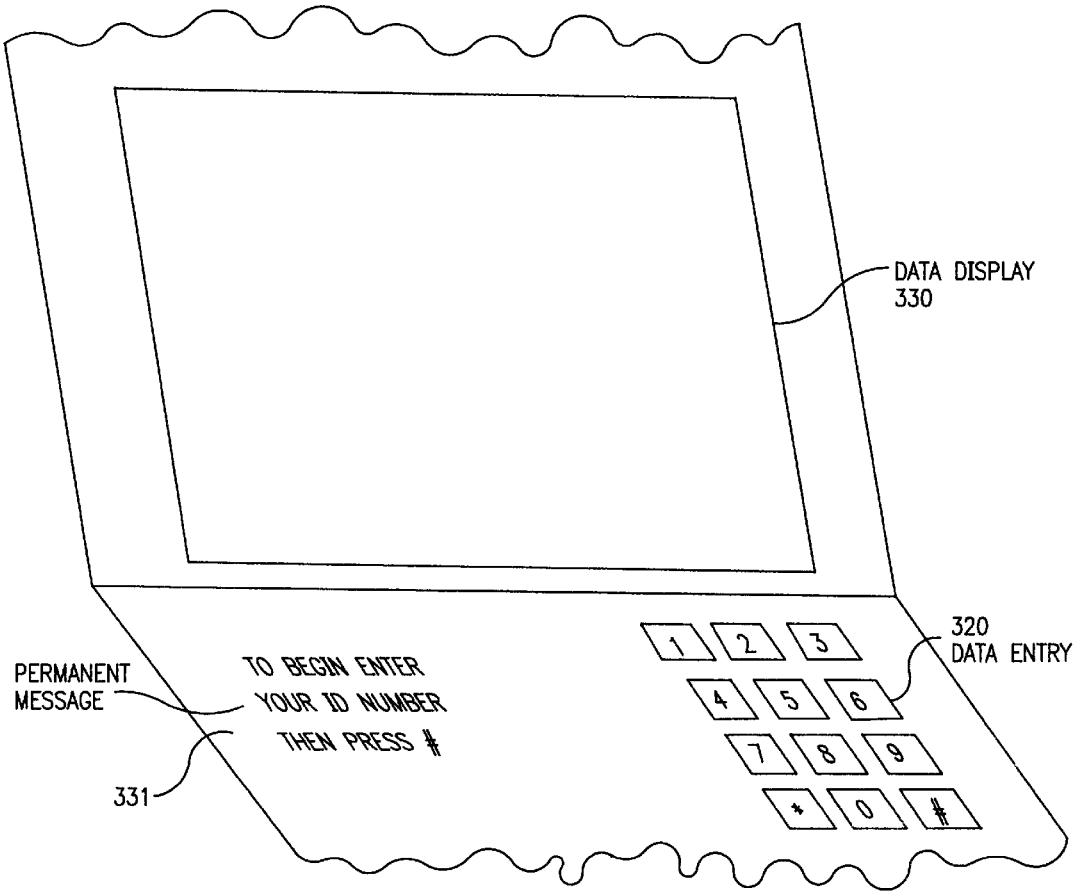

FIG. 3B shows a golfer's view of one embodiment of the data display 330, a permanent message 331, and data entry device 320 of the golfer's interface 300. In this embodiment, the data display 330 is a flat liquid-crystal type display with high-resolution graphics capabilities. The data entry device 320 is a telephone style numeric keypad. The golfer's interface 300 is in a quiescent state, conserving power until a golfer begins using it. In this quiescent state the data display is blank so a permanent message is printed near the data entry device 320 similar to the one shown instructing the golfer how to begin using the golfer's interface 300. After this step the golfer is guided through the use of the golfer's interface 300 by messages displayed on the data display device 330. The golfer requests information from the golfer's interface 300 by pressing numbers corresponding to menu items presented on the data display 330 as in a typical menu driven user interface. The corresponding tee number is entered through each data entry device 320 thus associating each golfer's interface 300 with a tee number. In one embodiment, the golfer's interface 300 while in the quiescent state does not respond to the polling signals from the manager's interface 200.

In one embodiment, one of the nodes of the golf network 100 is an advertisement dispersement node. This advertisement dispersement node communicates with the golfer's interface 300 through the manager's interface 200 at predetermined times in the sequence of communications between the golfer's interface 300 and the manager's interface 200, such as after the golfer's initial activation of the golfer's interface at each tee an advertisement for a sale of golf supplies at the golf course club house may be displayed on the golfer's interface 300 data display device 330. In another embodiment, the advertisement dispersement node is connected to the golf networks 100 of several golf courses 500 & 600 via the digital data modem and the telephone lines 700.

In one embodiment, the golfer's interface 300 contains an alert sounding device, such as a horn or speaker, that is activated when there is to be a general alert sent out to all the players on the golf course, such as a severe weather alert.

Figure 4:
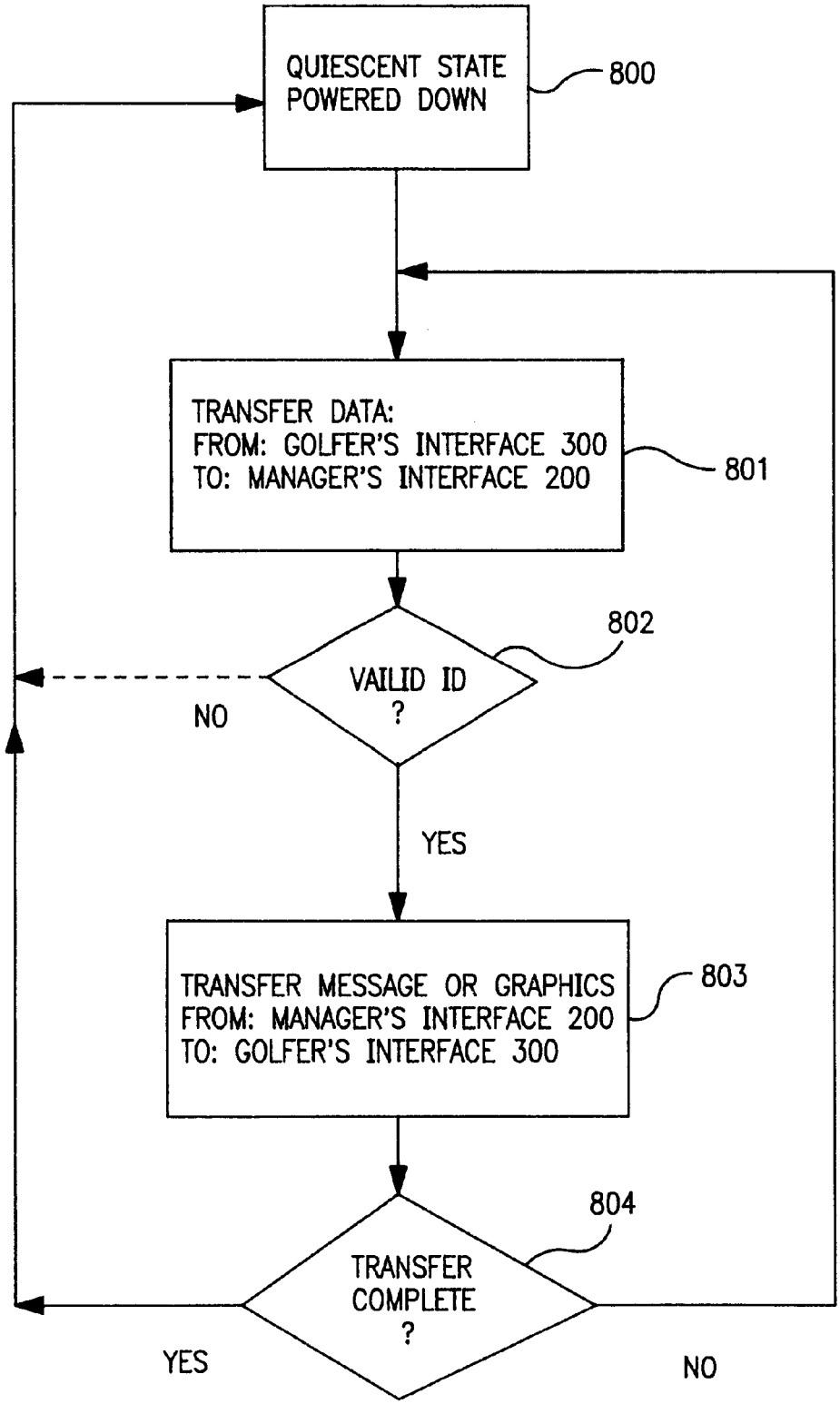
FIG. 4 is a high-level flowchart of one embodiment of the computer program that controls the golfer's interface 300.

FIG. 4 shows a high level flowchart of one embodiment of the sequence of operation the golfer's interface 300. Box 800 of FIG. 4 represents the golfer's interface 300 in the powered down or quiescent state waiting to be activated by a golf player. Box 801 of FIG. 4 represents transfer of data from the golfer's interface 300 to the manager's interface 200 after the golfer's interface 300 has been activated by a golfer and the appropriate information has been entered by the golfer. Box 802 represents the action taken by the manager's interface 200 after receiving the golfer's interface 300 data. In this embodiment, the manager's interface 200 validates the golfer's identification. If the identification is invalid, the manager's interface 200 causes the golfer's interface 300 to return to the quiescent state. Box 803 represent the transfer of data from the manager's interface 200 to the golfer's interface 300. The data in this embodiment can be either message format or graphical data. Box 804 represents the ending sequence of the exchange of data between the golfer's interface 300 and the manager's interface.

Figure 5:
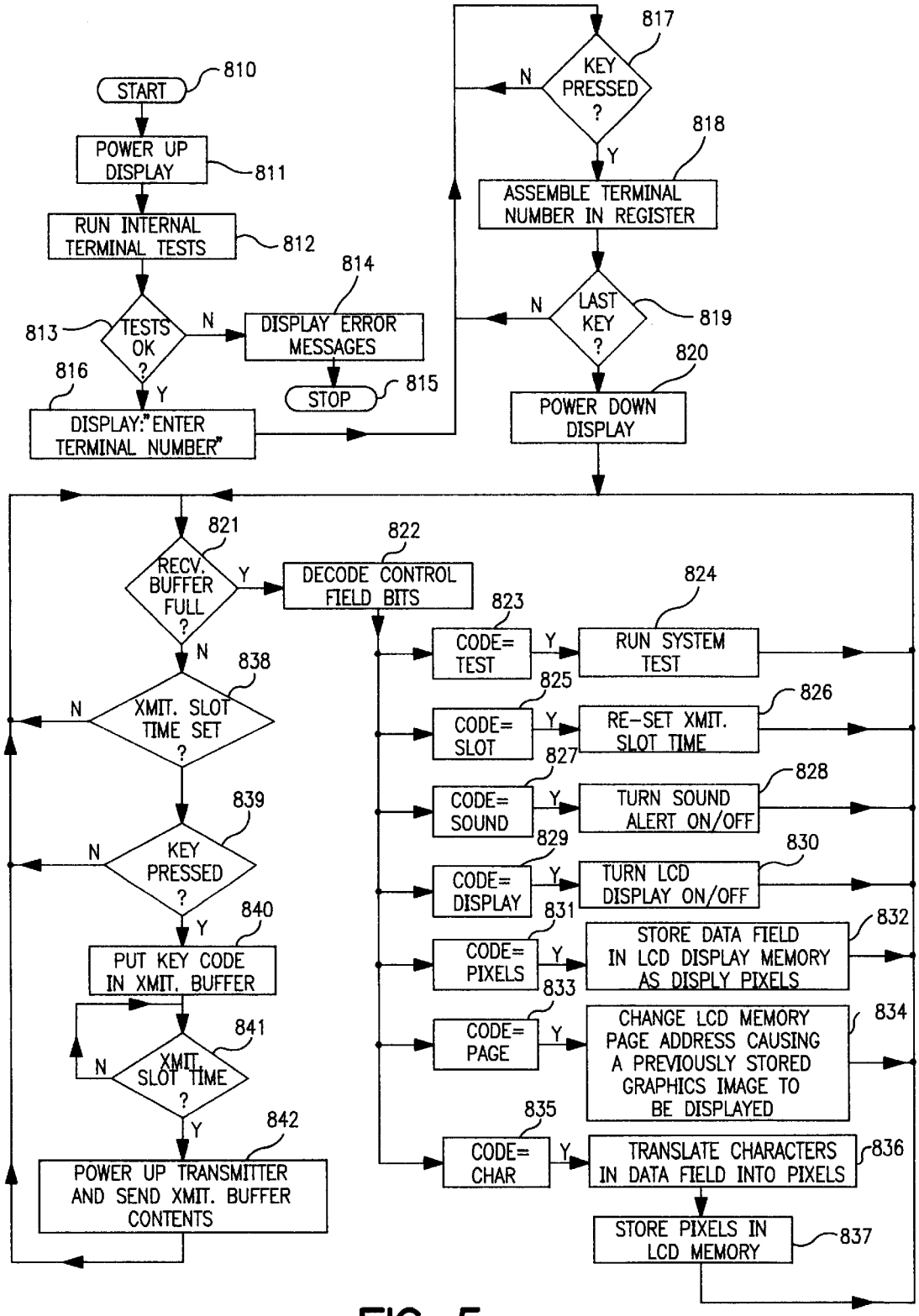
FIG. 5 is a detailed flowchart of one embodiment of the control flow of the golfer's interface 300.

FIG. 5 is one embodiment of a detailed flowchart of the control flow of the golfer's interface 300. The sequence begins at box 810 with the golfer's interface 300 being in the quiescent state. Box 811, upon activation of the power up device, such as a key switch or magnetic stripe reader, by maintenance personnel, the golfer's interface 300 powers up the data display device 330 and runs the internal test sequences, box 812, that are contained in the golfer's interface 300. If the internal tests run without any error condition detected, the golfer's interface 300 displays on the data display device 330, a message to the maintenance person instructing them to enter the terminal number. If an error condition was detected, an error message is displayed on the data display device 330, and after a preset time, the golfer's interface enters the quiescent state, boxes 813, 814, 815, & 816–820 to complete initialization. Once the sequence of control flow has passed this point, the activity as represented by boxes 821 through 842 proceeds based upon the golfer's interface 300 sensing activation of the data entry 320 keys or receipt of signals from the manager's interface 200.

Figure 6:
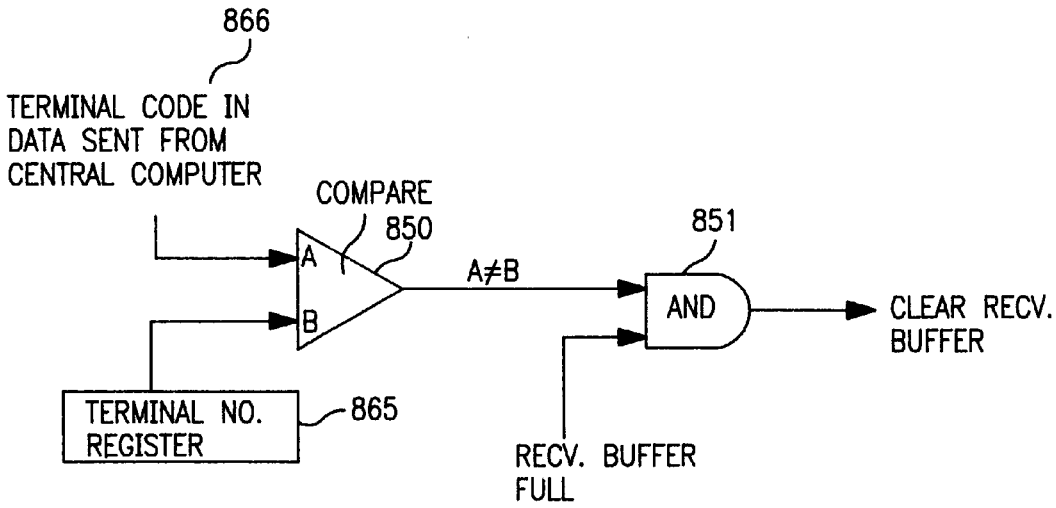
FIG. 6 is a schematic of one embodiment of the transmit and receive timing control of the golfer's interface 300.
Figure 6:
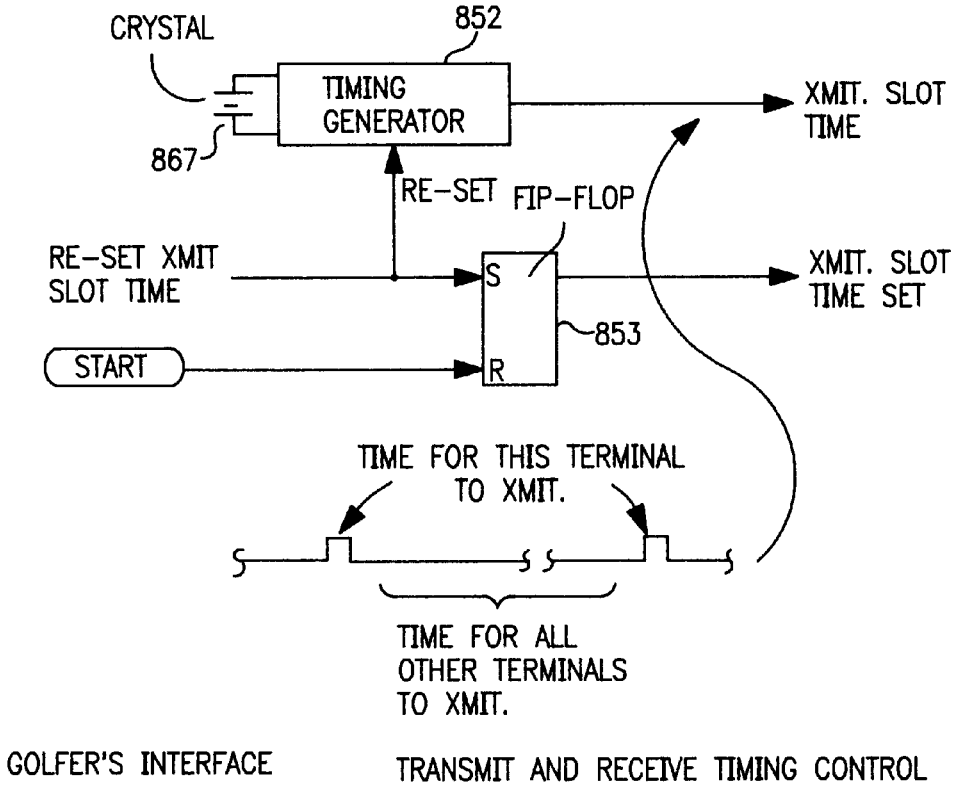

FIG. 6 is one embodiment of the transmit and receive timing control of the golfer's interface 300. Comparator 850 compares the address of the golfer's interface 300 (i.e., terminal code 866) contained in the data received from the manager's interface 200 to the actual address set in, e.g., terminal register 865 in one of the plurality of golfer's interfaces 300. If the received address is not the same as the address set in the golfer's interface 300 and the receive data buffer 340 in the golfer's interface 300 is full, the receive data buffer 340 in the golfer's interface 300 is cleared. Timing generator 852 and flip-flop 853 are combined to generate the transmit slot time and the set signal for the transmit time slot.

Figure 7:
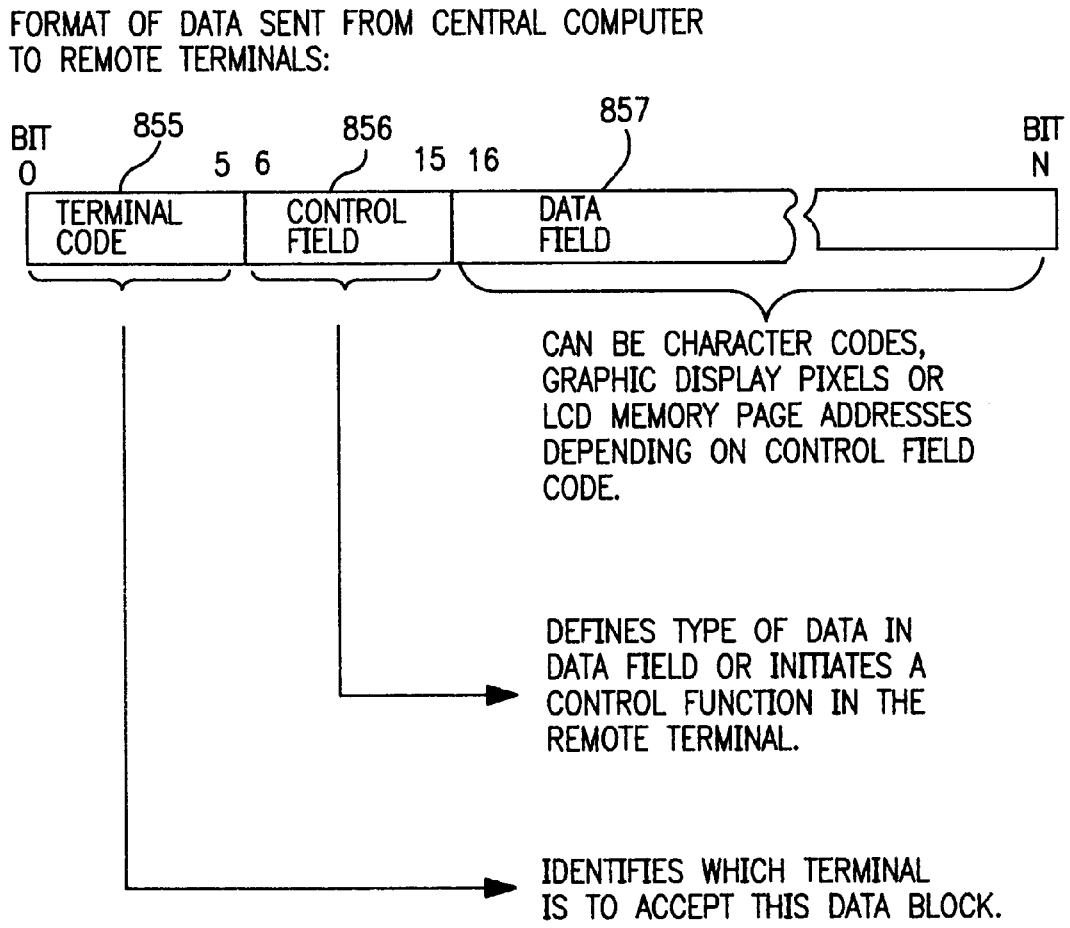
FIG. 7 is one embodiment of the format of data sent from the manager's interface 200 to the golfer's interface 300.

FIG. 7 is one embodiment of the format of the data stream that is sent from the manager's interface 200 to the golfer's interface 300. It is seen in this embodiment that the first field, terminal code 855 in the data is the address of the golfer's interface 300 to whom this stream of data is intended to receive. The second field control field 856 in this embodiment contains the control information enabling the golfer's interface to handle to proceeding data field 857 as either character data or graphical data.

Figure 8:
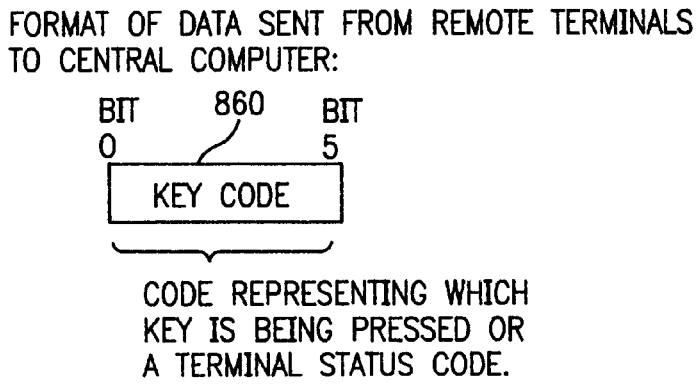
FIG. 8 is one embodiment of the format of the data sent from the golfer's interface 300 to the manager's interface 200.

FIG. 8 is one embodiment of the data 860 sent from the golfer's interface 300 to the manager's interface 200. It is seen that key code data 860 is a binary representation of a specific key of data entry device 320 currently being activated.

Figure 9:
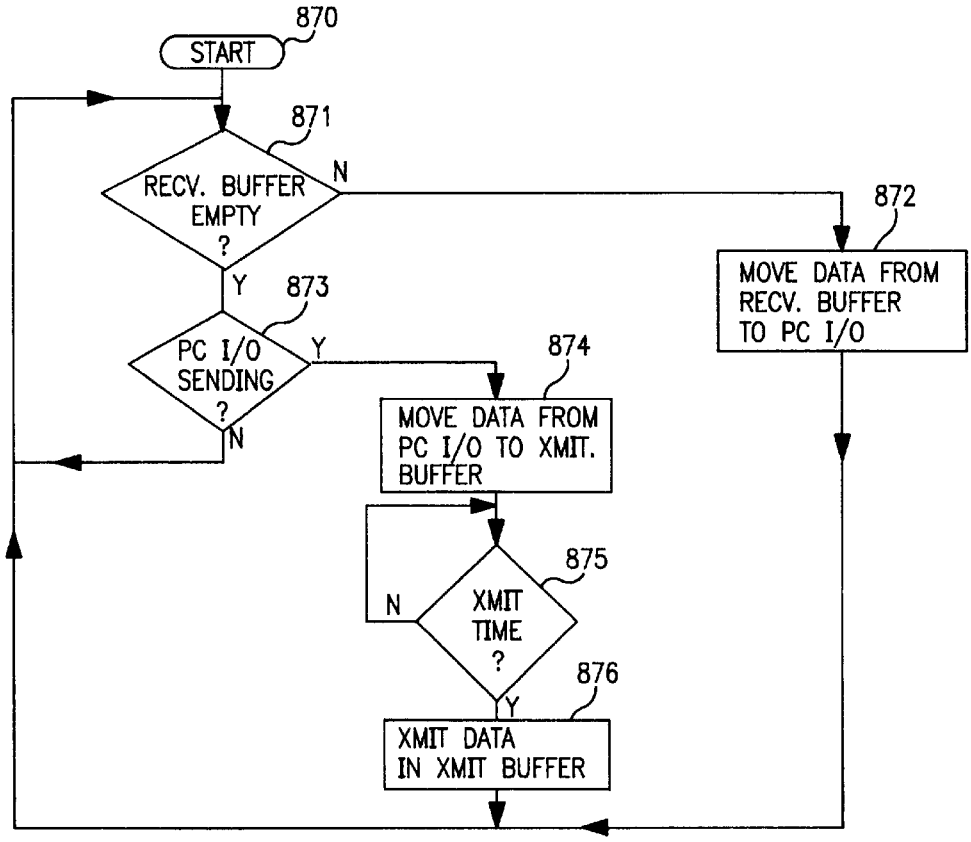
FIG. 9 is one embodiment of the control flow of the manager's interface 200 data buffer and transceiver.
Figure 9:
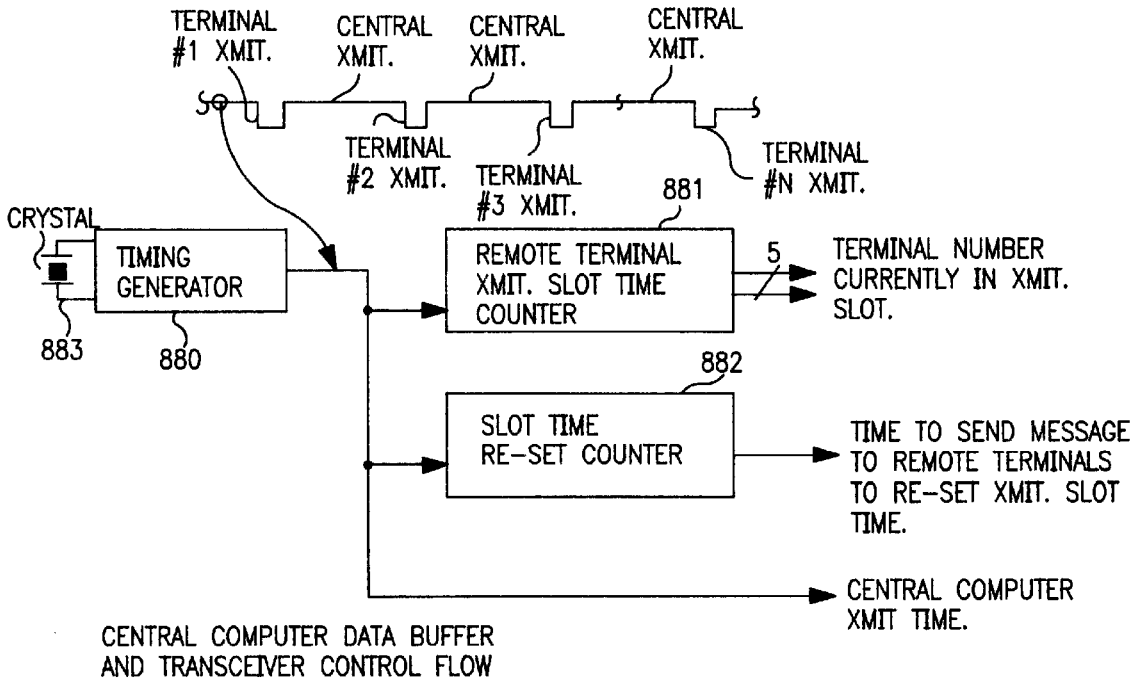

FIG. 9 is one embodiment of the control flow of the data buffer 270 and transceiver 210 of the manager's interface 200. Boxes 870, 871, 872, 873, 874, 875 and 876 represents the control flow, either electronics, computer program, or a combination of electronics and computer program ("Firmware") detecting buffer empty conditions and moving data to the transmit data buffer 270. Boxes timing generator 880 and crystal 883, remote terminal XMIT slot time counter 881, and slot-time reset counter 882 represent the electronics generating the electronic signals used to control the electronics of the transmit electronics.

In one preferred embodiment, when a golfer or group of golfers arrives at the golf course, they notify a manager in the club house and are given an identification which distinguishes them from other players. This can be a physical ID such as a coded card or a key or a remembered code that is kept private like a lock combination. They move to the first tee at their designated time where they approach the golfer's interface 300.

One member of the group transfers the ID through the data entry device 320 on the golfer's interface 300 at the first tee. This causes the golfer's interface 300 to become active and begin receiving the polling signals sent from the manager's interface 200. The golfer's ID is held in the data buffer 340 for a brief period until this golfer's interface 300 receives a polling signal containing the signal that uniquely identifies the golfer's interface 300. The golfer's ID is sent through the transceivers 210 & 350 and antennas 220 & 310 communication system to the computer 230 in the manager's interface 200. The software is thus notified that this group has begun play. Various data may be requested or entered by this group of players at this time as defined later in this section, but none is required. If no data is transferred then this golfer's interface 300 returns to a quiescent state in which no data is received, sent or displayed.

The group plays the first hole keeping count of strokes and arrives at the second tee. Their ID is entered and transferred as previously described at tee 1. Upon receiving and recognizing the ID sent by the golfer's interface 300 at tee 2 the software on the computer 230 in the manager's interface 200 sends a message identified as destined for tee 2. The message may be received by the transceivers 350 in other golfer's interfaces 300 if they are being used by a player but is only accepted by tee 2 and is discarded by all the others. It passes through the data buffer 340 and is displayed on the data display device 330. This message requests the golfers to enter their stroke counts from hole one. The counts are entered and passed through the system to the software in the manager's interface 200 at the polling time. This is the only transfer of information required. Various other information can be exchanged between the system and the golfers if they request it as described later in this section. If there is a message for a member of the group present at this golfer's interface 300, this will be indicated on the data display device 330 at this time. If this is a personal message, his ID will have to be entered for the message to be displayed. Group messages such as weather warnings are displayed immediately after any player's ID is entered. Emergencies such as medical or security can be communicated through the system quickly by simply entering 911 through the data entry device 320 without an ID. Information is requested by the golfers by entering numbers that correspond to items displayed in a menu of available information on the data display. When no more data is to be transferred at this tee, golfer interface 300 returns to the quiescent state.

The players continue to play the remaining holes repeating the interactions described for tee two until all holes are played. An additional golfer's interface 300 identical to those at each tee is located near the end of the last hole for recording strokes at the last hole. Golfers return to the club house where they can receive the printed results of their game.

The computer 230 in the manager's interface 200 processes all the stroke counts accumulated through the described communication steps and applies the player's handicaps and other modifiers to the score calculations. Handicaps are updated and saved for future use on the system's data storage device 240. This handicap information thus calculated and saved can be accessed through digital data modems 280 and telephone lines 700 by all other golf courses 500 & 600 with similar systems as the players play these courses.

A variety of other useful information can be transferred between the manager's interface 200 and the players at the golfer's interface 300 or though the printed results at the club house. These include but are not limited to the following: Weather information and warnings, course topology and layout, advertising, service needs emergency medical security, rules of play and personal messages. When information is requested from the golfer by the manager's interface 200 the request is displayed at the golfer's interface 300 after the golfer's ID is entered there. When no further information is requested from the golfer then he can select information he wants from a displayed menu of available information. The selection is encoded and transmitted at the polling time to the manager's interface 200. The manager's interface 200 transmits the requested data to the golfer's interface 300 for display on the data display device 330.

Additionally, golf network 100 can be utilized to share information between other golf courses 500 & 600 in a real time mode of communications. Such sharing of information can include but is not limited to: 1) Golf tournaments played at separate golf courses during the same day with the scores of the participant golfers being distributed and displayed as the scores are entered at the end of each hole played. Thus the status of the individual golfers or teams of golfers is known immediately instead of waiting until the end of the tournament to collect, tabulate, apply handicaps, and display the scores of the golfers. 2) The handicap of an individual golfer can be kept current and used as the golfer plays golf on different courses that are linked by the golf network 100. This will result in a consistent interlinked handicap maintenance system, e.g., the best 10 best scores in the past 20 games.

It is to be understood that the above description is intended to be illustrative, and not restrictive. Many other embodiments will be apparent to those of skill in the art upon reviewing the above description. For example, the data entry device 320 has been shown and described as a key entry pad. The data entry device 320 could include a microphone with associated electronics and software needed to convert the spoken words to digital signals recognizable by the manager's interface 200. The scope of the invention should, therefore, be determined with reference to the appended claims, along with the full scope of equivalents to which such claims are entitled.

What is claimed is:

1. A scoring and management system for one or more golf courses, each golf course including one or more golf holes, the system comprising:

a central computing device, including a processor and storage medium;

a plurality of remote terminals geographically dispersed and fixedly positioned about a golf course, each remote terminal including a) a manual input device for selectively entering one or more golf scores of a completed hole and information, wherein each manual input device is integral with an associated remote terminal, b) means for receiving information from the central computing device, and c) means for displaying information received from the central computing device; and means for transferring golf scores and information between the remote terminals and the central computing device in real time, wherein information is from the group consisting of advertisement, weather, service, emergency, personal message, course layout and topology, rule of play, gaming, and security information.

2. The system of claim 1, wherein a remote terminal is positioned adjacent a tee box associated with each of the plurality of holes of the golf course and a remote terminal is positioned adjacent a green of a hole designated as a final hole of the golf course.

3. The system of claim 1, wherein the remote terminals are geographically dispersed so that a golfer enters a score into a remote terminal upon completing each hole of the golf course.

4. The system of claim 1, wherein a code identifies each golfer playing on a golf course.

5. The system of claim 1, wherein the central computing device is operably connected with one or more central computing devices, wherein each central computing device is associated with one golf course.

6. The system of claim 1, wherein the means for transferring information includes a wireless communication system.

7. The system of claim 1, wherein the means for transferring information includes a wire or fiber optic connection between the central computing device and each of the remote terminals.

8. The system of claim 1, wherein the means for transferring information includes means for the central computing device to periodically poll each of the remote terminals to determine if any new information has been entered into a remote terminal since the terminal was last polled.

9. The system of claim 1, wherein the remote terminals are solar powered.

10. The system of claim 1, further comprising one or more display screens operably connected with the central computing device for displaying the scores of the golfers playing on a course.

11. The system of claim 1, wherein the central computing device includes means for computing a golfer's handicap on a hole-by-hole basis as the golfer's scores are received from remote terminals and sending this information to one or more remote terminals.

12. The system of claim 1, wherein the central computing device includes means for calculating speed of play and course utilization information based on the information received from the remote terminals and sending one or more messages to one or more remote terminals based on the calculations.

13. A method of managing and score keeping for a golf course, comprising the steps of:

assigning each golfer to play on a course an identifier code;

fixedly positioning a plurality of remote player terminals about a golf course so that one or more golfers manually enter the golfer's score for each hole into a fixed terminal upon completion of that hole by entering the golfer's identifier code; sending the golf score information of each golfer for each hole from each of the remote terminals to a central computer in real time so that a total score for a round for each golfer is recorded and updated hole-by-hole.

14. The method of claim 13, wherein the step of periodically sending the golf score information of each golfer for each hole includes the central computer periodically polling each of the remote terminals.

15. The method of claim 13, further including the step of displaying the score for each golfer on one or more display screens.

16. The method of claim 13, further comprising the step of selectively communicating between the central computer and one or more remote terminals the score of one or more players on the course, an updated handicap of one or more players on the course, advertisements, weather information, service information, emergency information, a personal message accessed by identifier code, course layout and topology, rule of play information, gaming information, and security information.

17. The method of claim 13, further comprising the step of calculating a speed of play and course utilization and sending a message to one or more remote terminals based on the calculations, wherein the message is designed to require one or more golfers to alter the golfer's play so that the speed of play or course utilization is improved.

* * * * *